US006352301B1

(12) United States Patent
Chu

(10) Patent No.: US 6,352,301 B1
(45) Date of Patent: Mar. 5, 2002

(54) FOLDING COLLAPSIBLE CHAIR, AND FOLDING COLLAPSIBLE ROD MEMBER CONNECTING STRUCTURE FOR THE CHAIR

(76) Inventor: Kuo Yi Chu, No. 23, Alley 3, Lane 1483, Chung-Hwa Rd., Chupei City, Hsinchu (TW)

( * ) Notice: Subject to any disclaimer, the term of this patent is extended or adjusted under 35 U.S.C. 154(b) by 0 days.

(21) Appl. No.: 09/899,121

(22) Filed: Jul. 6, 2001

(51) Int. Cl.[7] ..... A47C 4/42
(52) U.S. Cl. ..... 297/59; 297/41; 403/102
(58) Field of Search ..... 297/35, 41, 59; 403/100, 101, 102

(56) References Cited

U.S. PATENT DOCUMENTS 2,699,557 A * 1/1955 Gravatt ..... 297/60 X
4,052,087 A * 10/1977 Gagliardi ..... 297/60 X
4,810,029 A * 3/1989 Kaladis et al. ..... 403/102 X
5,577,799 A * 11/1996 St Germain ..... 297/41 X
5,709,428 A * 1/1998 Hugghins ..... 297/16.2

* cited by examiner

*Primary Examiner*—Peter R. Brown
(74) *Attorney, Agent, or Firm*—Rosenberg, Klein & Lee

(57) ABSTRACT

A folding collapsible rod member connecting structure includes a first tubular rod member, a second tubular rod member, a barrel fixedly mounted on the first tubular rod member, the barrel having a locating block protruded from the periphery thereof, a coupling block fixedly fastened to one end of the second tubular rod member, the coupling block having a protruding rod pivoted to the locating block, a locating sleeve coupled to the first tubular rod member by a slip joint and moved between a first position where the locating sleeve has a part sleeved onto the first tubular rod member and a part sleeved onto the locating block to stop the first tubular rod member from turning relative to the second tubular rod member and a second position where the locating sleeve is disengaged from the locating block for enabling the first tubular rod member to be turned relative to the second tubular rod member, and an elastic band connected between the coupling block and a pin at the locating sleeve and adapted to pull the locating sleeve from the second position to the first position.

5 Claims, 5 Drawing Sheets

FOLDING COLLAPSIBLE CHAIR, AND FOLDING COLLAPSIBLE ROD MEMBER CONNECTING STRUCTURE FOR THE CHAIR

BACKGROUND OF THE INVENTION

The present invention relates to a folding collapsible chair and, more specifically, to a folding collapsible rod member connecting structure for a folding collapsible chair, which enables two tubular rod members to be folding-collapsibly connected at right angles.

Frame tubes and tubular rod member connectors are intensively used for making chairs. These chairs include two types, namely, the fixed type and the folding collapsible type. A chair of fixed type requires much storage and transportation space. A chair of folding collapsible design can be folded up and collapsed to minimize space occupation when not in use or during its transportation. However, regular tubular rod member connectors for folding collapsible chairs commonly use a lock pin for locking the respective frame tubes in the working or collapsed position. The frame tubes can be turned relative to each other only when the lock pin is removed. When turned from the working position to the collapsed position or from the collapsed position to the working position, the lock pin must be installed again to lock the frame structure in the collapsed or working position. Because the lock pin has a protruding part disposed outside the frame structure, the body or clothes of the user may be injured or torn by the protruding part of the lock pin by an accident.

SUMMARY OF THE INVENTION

The present invention has been accomplished under the circumstances in view. It is one object of the present invention to provide a folding collapsible tubular rod member connecting structure, which is practical for use in a folding collapsible chair. It is another object of the present invention to provide a folding collapsible tubular rod member connecting structure for a folding collapsible chair, which is easy to operate. According to one aspect of the present invention, a folding collapsible chair comprises a substantially ⊓-shaped back frame tube, two angled front frame tubes bilaterally connected to the back frame tube, two folding collapsible rod member connecting structures respectively connected between the front frame tubes and the back frame tube, a substantially U-shaped seat frame tube fixedly fastened to the angled front frame tubes and holding a seat, the seat frame tube having two distal ends respectively pivoted to the back frame tube by a respective pivot, and two transverse tubes bilaterally connected between the angled front frame tubes and the back frame tube, the transverse tubes each having one end respectively fixedly connected to the front frame tubes and an opposite end connected to the back frame tube by a respective hinge means. According to another aspect of the present invention, the folding collapsible rod member connecting structure comprises a first tubular rod member, a second tubular rod member, a barrel fixedly mounted on the first tubular rod member, the barrel having a locating block protruded from the periphery thereof, a coupling block fixedly fastened to one end of the second tubular rod member, the coupling block having a protruding rod pivoted to the locating block, a locating sleeve coupled to the first tubular rod member by a slip joint and moved between a first position where the locating sleeve has a part sleeved onto the first tubular rod member and a part sleeved onto the locating block to stop the first tubular rod member from turning relative to the second tubular rod member and a second position where the locating sleeve is disengaged from the locating block for enabling the first tubular rod member to be turned relative to the second tubular rod member, and an elastic band connected between the coupling block and a pin at the locating sleeve and adapted to pull the locating sleeve from the second position to the first position.

DETAILED DESCRIPTION OF THE PREFERRED EMBODIMENT

Figure 1:
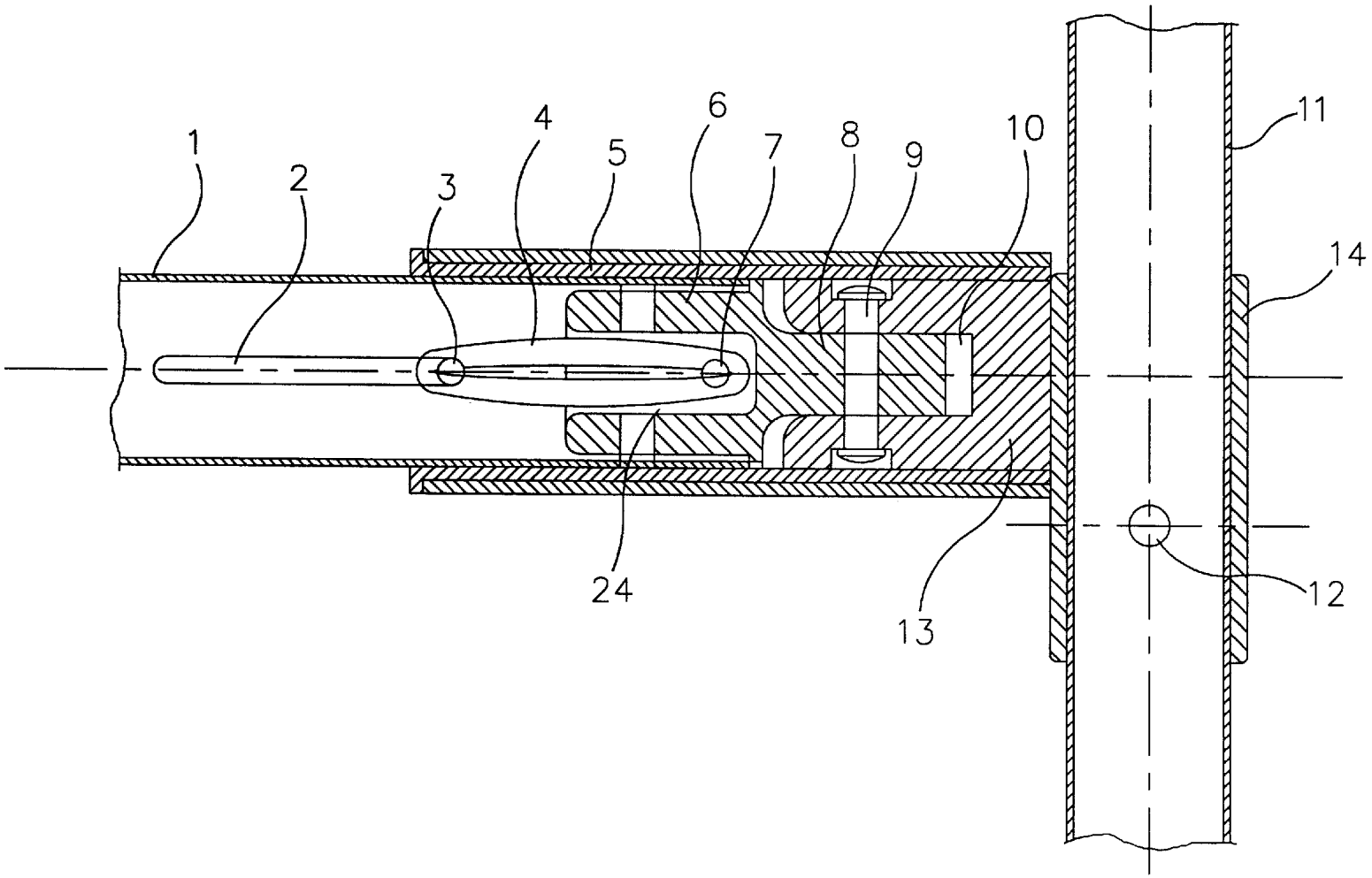
FIG. 1 is a sectional view of a folding collapsible tubular rod member connecting structure according to the present invention.
Figure 2:
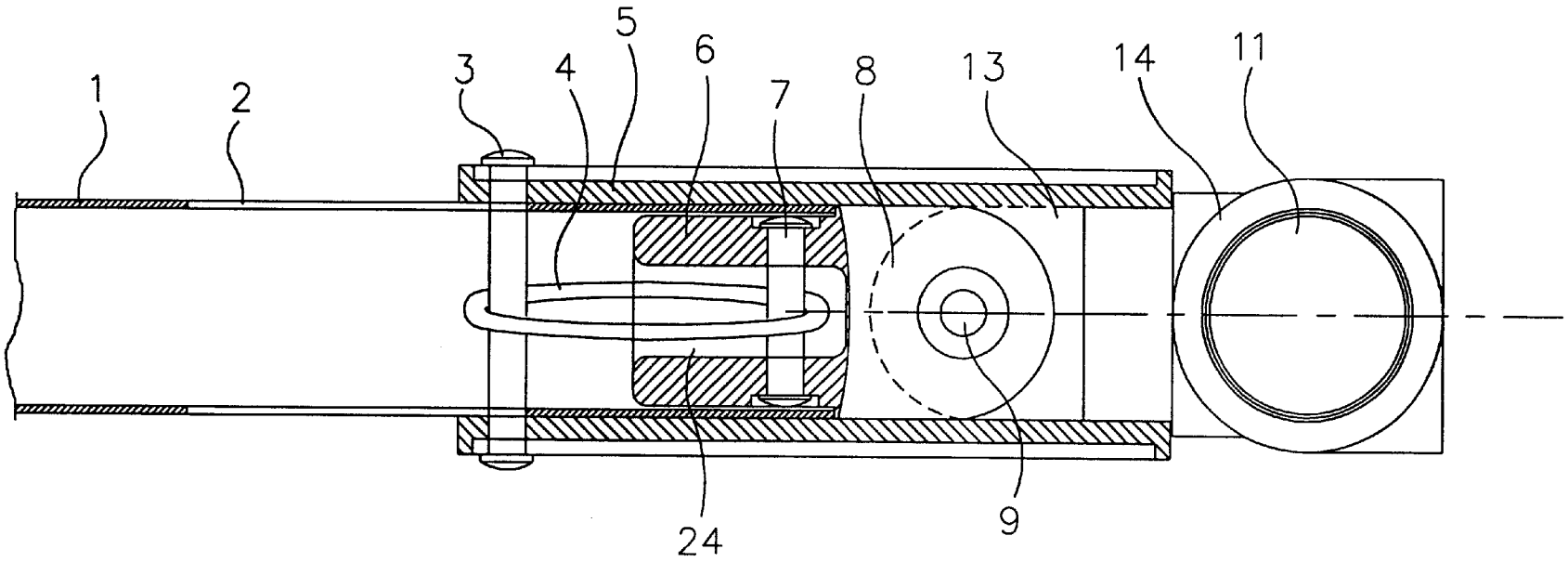
FIG. 2 is a sectional view taken along line A—A of FIG. 1.
Figure 3:
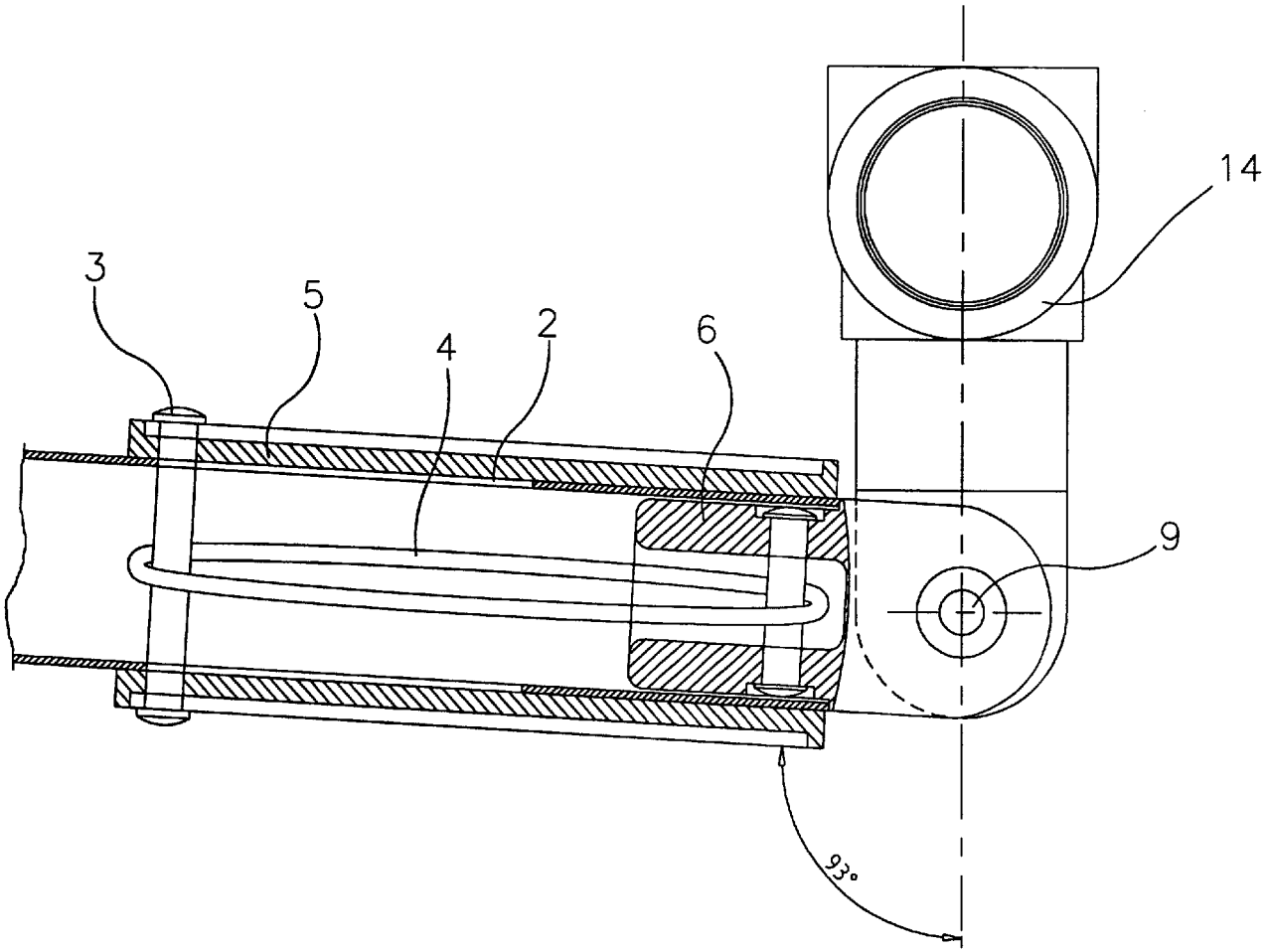
FIG. 3 is another sectional view of FIG. 2 showing the first tubular rod member turned relative to the second tubular rod member through an angle about 93°.

Referring to FIGS. 1, 2 and 3, a barrel 14 is shown comprising a locating block 13 perpendicularly extended from the periphery thereof. The locating block 13 has a front slot 10 across the periphery. A first tubular rod member 1 is coupled to the locating block 13. The tubular rod member 1 has one end fixedly mounted with a coupling block 6. The coupling block 6 has a protruding rod 8 disposed at its one end and inserted into the front slot 10 of the locating block 13 and secured thereto by a pivot pin 9, and a longitudinal center hole 24 disposed at its other end. The first tubular rod member 1 has a longitudinal sliding slot 2 disposed across the periphery adjacent to the coupling block 6. A locating sleeve 5 is slidably mounted on the first tubular rod member 1. A pin 3 is inserted through the longitudinal sliding slot 2, having two distal ends respectively fastened to one end, namely, the rear end of the locating sleeve 5. Therefore, the sleeve 5 can be moved with the pin 3 along the longitudinal sliding slot 2 between two positions, namely the locating position (see FIGS. 1 and 2) and the unlocking position (see FIG. 3). A pin 7 is transversely fastened to the coupling block 6 across the inner end of the longitudinal center hole 24. An elastic band 4 is mounted on the pin 3 at the locating sleeve 5 and the pin 7 at the coupling block 6. A second tubular rod member 11 is inserted through the barrel 14 and fixedly connected thereto by a locating pin 12. Normally, the elastic band 4 pulls the pin 3 toward the pin 7, keeping the locating sleeve 5 in the locking position, i.e., the locating sleeve 5 is maintained partially sleeved onto the locating block 13 of the barrel 14, prohibiting the first tubular rod member 1 from turning relative to the second tubular rod member 11. When pulling the locating sleeve 5 backwards from the locking position to the unlocking position, the locating block 13 is released from the constraint of the locating sleeve 5, and the first tubular rod member 1 can then be turned about the pivot pin 9 relative to the barrel 14 and the second tubular rod member 11 within about 0~93° (see FIG. 3). The connection between the first tubular rod member 1 and the second tubular rod member 11 forms a folding collapsible rod member connecting structure 15 (see FIG. 4).

Figure 4:
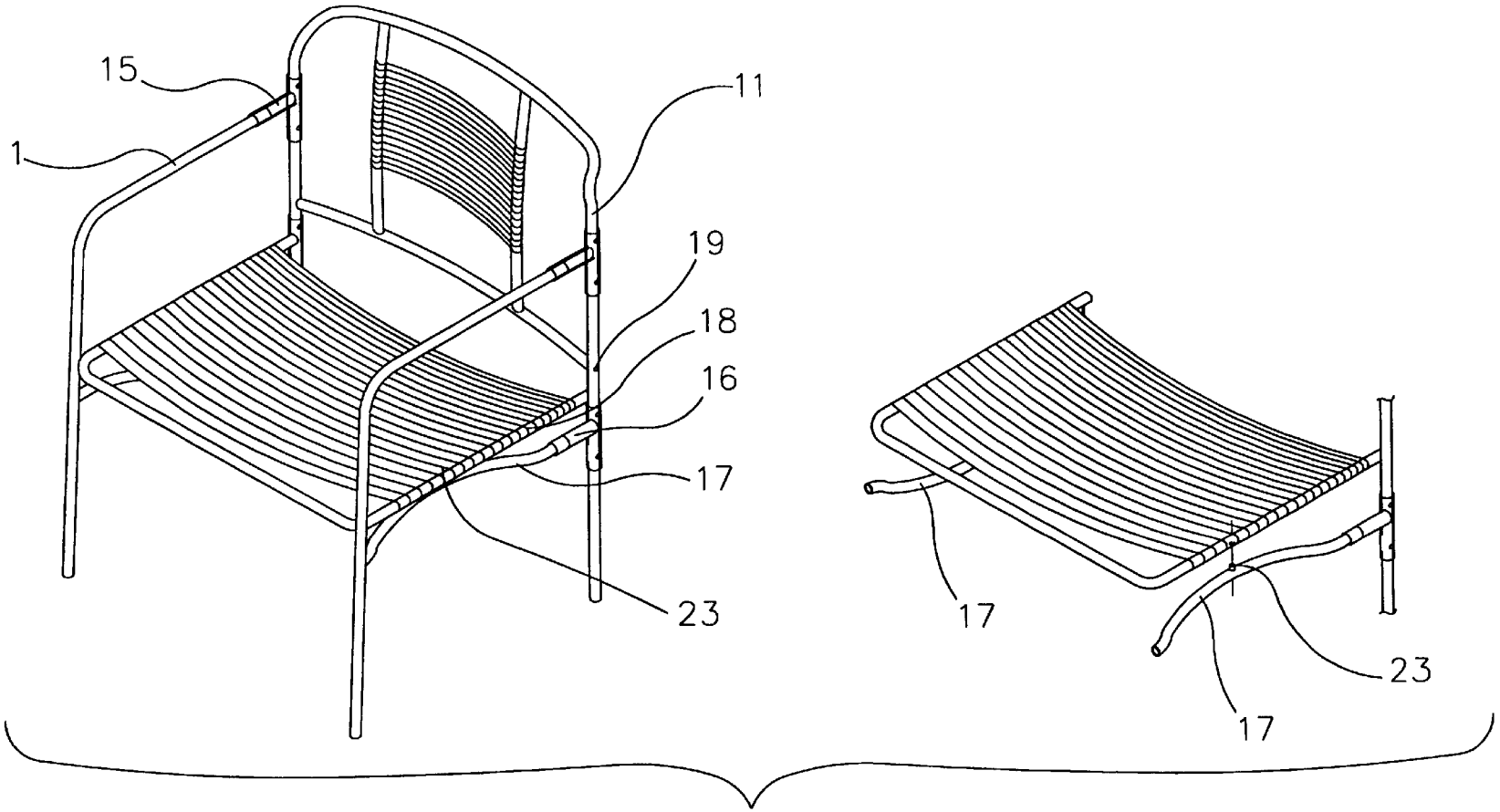
FIG. 4 is an elevational view of a folding collapsible chair constructed according to the present invention
Figure 5:
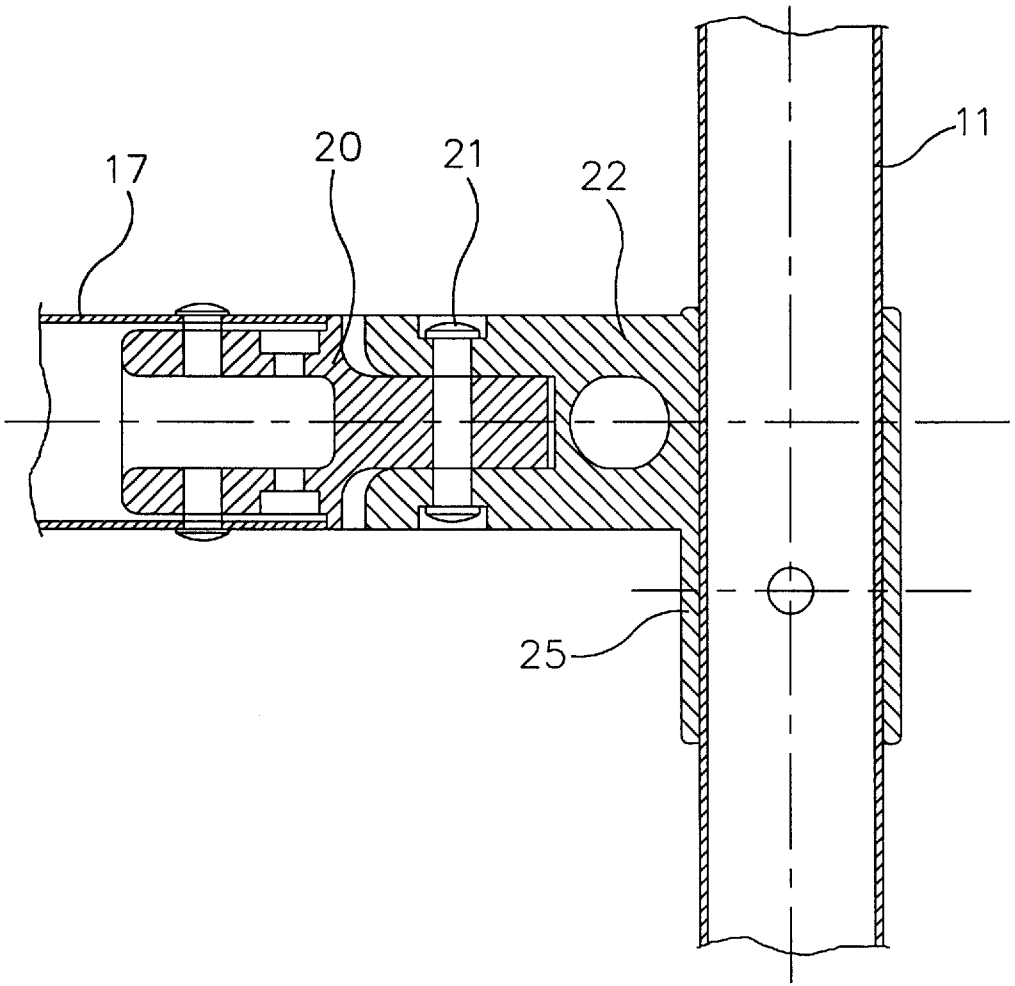
FIG. 5 is an enlarged view of a part of FIG. 4.

Referring to FIGS. 4 and 5, a folding collapsible chair is shown comprising a substantially ⊓-shaped back frame tube (the aforesaid second tubular rod member) 11, two angled front frame tubes (the aforesaid first tubular rod member) 1 bilaterally connected to the back frame tube 11 by a respective folding collapsible rod member connecting structure 15, a substantially U-shaped seat frame tube 18 fixedly fastened to the angled front frame tubes 1 and holding a seat, the seat frame tube 18 having two distal ends respectively pivoted to the back frame tube 11 by a respective pivot 19, and two transverse tubes 17 bilaterally connected between the angled front frame tubes 1 and the back frame tube 11. The transverse tubes 17 are respectively curved upwards to support the U-shaped seat frame tube 18, each having one end respectively fixedly connected to the front frame tubes 1, the other end connected to the back frame tube 11 by a respective hinge means 16, and a curved middle part provided with a locating pin 23, which is plugged into a respective pinhole on the seat frame tube 18. The hinge means 16 comprises a barrel 25 fixedly fastened to the back frame tube 11, the barrel 25 having a locating block 22 perpendicularly integral with the periphery thereof, and a coupling block 20, the coupling block 20 having one end fixedly connected to one end of the corresponding transverse tube 17 and the other end pivoted to the locating block 22 by a pivot 21.

When pulling the locating sleeve 5 of each folding collapsible rod member connecting structure 15 backwards from the locking position to the unlocking position, the transverse tubes 17 and the seat frame 18 can then be turned with the front frame tubes 1 relative to the back frame tube 11 to collapse the chair. On the contrary, when turning back the front frame tubes 1, the locating sleeve 5 of each folding collapsible rod member connecting structure 15 is pulled by the respective elastic band 4 from the unlocking position to the locking position to lock the chair in the operative position.

What the invention claimed is:

1. A folding collapsible chair comprising a substantially ⊓-shaped back frame tube, two angled front frame tubes bilaterally connected to said back frame tube, two folding collapsible rod member connecting-structures respectively connected between said front frame tubes and said back frame tube, a substantially U-shaped seat frame tube fixedly fastened to said angled front frame tubes and holding a seat, said seat frame tube having two distal ends respectively pivoted to said back frame tube by a respective pivot, and two transverse tubes bilaterally connected between said angled front frame tubes and said back frame tube, said transverse tubes each having one end respectively fixedly connected to said front frame tubes and an opposite end connected to said back frame tube by a respective hinge means, wherein said folding collapsible rod member connecting structures each comprise a barrel fixedly mounted on said back frame tube, said barrel comprising a locating block fixedly perpendicularly protruded from the periphery thereof, a coupling block, said coupling block having one end fixedly fastened to one end of the corresponding front frame tube and an opposite end pivoted to said locating block by a pivot, a longitudinal sliding slot formed on the corresponding front frame tube adjacent to said coupling block, a locating sleeve mounted on the corresponding front frame tube and moved in and out of the corresponding front frame tube between a first position where said locating sleeve has a part sleeved onto the corresponding front frame tube and a part sleeved onto said locating block to stop the corresponding front frame tube from turning relative to said back frame tube and a second position where said locating sleeve is disengaged from said locating block for enabling the corresponding front frame tube to be turned relative to said back frame tube, a pin inserted through said longitudinal sliding slot and fixed connected to said locating sleeve to limit the range of movement of said locating sleeve on the corresponding front frame tube, and an elastic band connected between said coupling block and the pin at said locating sleeve and adapted to pull said locating sleeve from said second position to said first position.

2. The folding collapsible chair of claim 1 wherein said coupling block has a longitudinal center hole disposed at one end thereof, and a pin transversely mounted in said longitudinal center hole and adapted to hold said elastic band.

3. The folding collapsible chair of claim 1 wherein said hinge means comprises a barrel fixedly fastened to said back frame tube, the barrel of said hinge means having a locating block perpendicularly integral with the periphery thereof, and a coupling block, the coupling block of said hinge means having one end fixedly connected to one end of the corresponding transverse tube and an opposite end pivoted to the locating block of said hinge means by a pivot.

4. The folding collapsible chair of claim 1 wherein said transverse tubes each have a middle part curved upwards, and said seat frame tube is supported on the curved middle part of each of said transverse tubes.

5. The folding collapsible chair of claim 4 wherein the curved middle part of each of said transverse tube has a fixed locating pin plugged into a respective pinhole on said seat frame tube.

* * * * *